US007055442B2

(12) United States Patent
Podd et al.

(10) Patent No.: US 7,055,442 B2
(45) Date of Patent: Jun. 6, 2006

(54) PORTABLE DESK WITH FOLD-OUT LEGS AND STORAGE

(75) Inventors: George O. Podd, Lake Forest, IL (US); Michael L. Nakamura, Crystal Lake, IL (US); James D. Morrow, Oak Park, IL (US)

(73) Assignee: Senario LLC, McHenry, IL (US)

( * ) Notice: Subject to any disclaimer, the term of this patent is extended or adjusted under 35 U.S.C. 154(b) by 0 days.

(21) Appl. No.: 10/655,825

(22) Filed: Sep. 5, 2003

(65) Prior Publication Data

US 2004/0107878 A1 Jun. 10, 2004

Related U.S. Application Data

(60) Provisional application No. 60/426,338, filed on Nov. 14, 2002.

(51) Int. Cl.
*A47B 85/00* (2006.01)

(52) U.S. Cl. ..... 108/25; 108/43; 108/35

(58) Field of Classification Search ..... 108/35, 108/34, 38, 41, 44, 132, 131, 130, 129, 25, 108/43

See application file for complete search history.

(56) References Cited

U.S. PATENT DOCUMENTS

| | | | | | |
|---|---|---|---|---|---|
| 14,877 | A | | 5/1856 | Lyford | |
| 240,057 | A | | 4/1881 | Waldecker | |
| 988,937 | A | | 4/1911 | Holland | |
| 1,309,774 | A | * | 7/1919 | Otte | 108/131 |
| 2,609,072 | A | | 9/1952 | Levinson | |
| 2,693,258 | A | | 11/1954 | Fleisch | |
| 4,049,091 | A | | 9/1977 | Chubb | |
| 4,557,200 | A | * | 12/1985 | Geschwender | 108/132 |
| 4,790,416 | A | | 12/1988 | Baker | |
| 4,934,549 | A | | 6/1990 | Allen | |
| 5,038,688 | A | * | 8/1991 | Permenter | 108/43 |
| 5,265,541 | A | * | 11/1993 | Gordon | 108/34 |
| 5,611,098 | A | | 3/1997 | Skibik | |
| 5,680,973 | A | | 10/1997 | Vulpitta et al. | |
| 5,833,200 | A | | 11/1998 | Patterson | |
| 5,871,094 | A | | 2/1999 | Leibowitz | |
| 6,032,586 | A | * | 3/2000 | Reyes | 108/43 |
| 6,044,758 | A | | 4/2000 | Drake | |
| 6,068,355 | A | | 5/2000 | Thorp | |
| 6,152,417 | A | * | 11/2000 | Randall | 108/43 |
| 6,164,213 | A | * | 12/2000 | Topps et al. | 108/43 |
| 6,170,405 | B1 | * | 1/2001 | Weitzman et al. | 108/25 |
| 6,173,656 | B1 | | 1/2001 | Blanchard | |
| 6,173,835 | B1 | | 1/2001 | Swinger et al. | |
| RE37,239 | E | * | 6/2001 | Eisenberg | 108/43 |
| D443,999 | S | | 6/2001 | Cable | |
| D455,025 | S | * | 4/2002 | Weitzman et al. | D6/406.5 |

* cited by examiner

FOREIGN PATENT DOCUMENTS

JP 2000-175746 6/2000

*Primary Examiner*—José V. Chen
(74) *Attorney, Agent, or Firm*—Pauley Petersen & Erickson

(57) ABSTRACT

A portable desk including a base having a bottom surface forming a plurality of storage compartments which define a storage space. A top portion is hingedly attached to the base and movable between an open position and a closed position. Legs are positioned at opposing end portions of the base and connected to the base to pivotally move with respect to the base between a retracted position and an extended position. Each leg preferably has an outer surface that forms a recessed, concave portion. At least one snap element locks each leg with respect to the base in the extended position and includes a tab section formed on a bottom surface of the base which interferes with or engages a support edge formed at an end portion of a corresponding leg.

27 Claims, 13 Drawing Sheets

PORTABLE DESK WITH FOLD-OUT LEGS AND STORAGE

This application claims the benefit of Provisional Application No. 60/426,338, filed Nov. 14, 2002.

BACKGROUND OF THE INVENTION

1. Field of the Invention

This invention relates to a portable desk including legs that are pivotally movable between a retracted position, wherein the portable desk forms a case structure, and an extended position to form a working station. The portable desk includes storage compartments.

2. Discussion of Related Art

Many conventional portable desks or work stations provide a working surface for use in bed, on the couch, on the floor or while traveling in a car, airplane, bus or train, for example. However, these conventional portable desks typically do not provide storage compartments adequate for storing writing utensils, arts and crafts supplies and school or work materials, nor do these portable desks include legs that are movably connected to the portable desk body and sufficiently strong to adequately support the portable desk during use.

There is an apparent need for a portable desk having storage space for storing writing utensils, arts and crafts supplies, and school or work materials.

There is also an apparent need for a portable desk having legs which are movable between a retracted position and an extended position to form a working station.

There is also an apparent need for a portable desk having legs which are secured or locked in an extended position, and sufficiently strong to provide a rigid support for the portable desk.

SUMMARY OF THE INVENTION

It is one object of this invention to provide a portable desk having storage compartments for storing writing utensils, arts and crafts supplies and school or work materials.

It is another object of this invention to provide a portable desk having pivotally connected legs that are movable between a retracted position, wherein the portable desk forms a case structure for easy portability and storage, and an extended position, wherein the legs can be secured or locked with respect to a base of the portable desk to provide a working station.

It is another object of this invention to provide a portable desk having legs with an outer surface having a concave recessed portion and/or opposing edge portions having an arcuate shape, to provide sufficient strength to rigidly support the portable desk.

The portable desk of the present invention has storage capability, and can be used in bed, on the couch, on the floor, on a table surface or while traveling in a car, an airplane, a bus or a train. The portable desk aids children and adults with homework activity, reading, writing, arithmetic, drawing, eating, snacking and entertainment with arts and crafts, games, video games, building blocks and drawing and painting. The portable desk is preferably made of a light weight material and integrates a carry handle for easy transportability (like a briefcase) and storage under a bed, or in a closet or an automobile.

The portable desk of the present invention preferably includes a base which defines a storage space. Preferably, the base forms or includes a plurality of compartments in a bottom surface of the base. In one preferred embodiment of this invention, at least one integrated support wall extends between a first side wall of the base and an opposing second side wall of the base to form the plurality of compartments.

A top portion of the portable desk is hingedly attached to the base and movable between an open position and a closed position. The top portion has a top surface that is preferably smooth and flat to provide a working surface. In one preferred embodiment of this invention, a ridge or a wall extends about at least a portion of a periphery of the top surface to prevent writing utensils and materials from rolling or falling off the top surface. The top portion may also include or form a recessed storage void for placing writing utensils or materials for temporary storage when the user is using the portable desk. In the closed position, the top portion is positioned over the base and securely connected to the base to cover the storage compartments and maintain the materials within the storage compartments. For example, the top portion may include a tab section that interferes with or engages a shoulder of the base, in the closed position. In one preferred embodiment of this invention, the top portion and the base form an integrated carry handle.

The portable desk includes two legs that are positioned at opposing end portions of the base and pivotally connected to the base. Each leg is pivotally movable between a retracted position and an extended position with respect to the portable desk base, and securable or lockable in the extended position to provide sufficient support for the portable desk during use. In one preferred embodiment of this invention, at least one snap element secures or locks each leg to the base in the extended position. The snap element includes a tab formed on a bottom surface of the base that interferes with or engages a support edge formed at an end portion of a corresponding leg, in the extended position.

Preferably, each leg includes an outer surface having a concave recessed portion. In the extended position, the concave portion forms a handle within the leg, preferably at an end portion of the leg, for positioning the portable desk with respect to the user's lap, for example. Additionally or alternatively, opposing edge portions of the leg may have an arcuate shape. For example, the opposing edge portions may curve inwardly with respect to the portable desk to correspond to at least a portion of one of a first side wall and a second side wall of the base. Each leg may form a storage compartment and include a cover that is pivotally connected to the leg and positioned with respect to the storage compartment to contain materials stored within the storage compartment. The cover is pivotally movable with respect to the leg to access the storage compartment.

BRIEF DESCRIPTION OF THE DRAWINGS

The above and other features and objects of this invention will be better understood from the following detailed description taken in view of the drawings, wherein.

DESCRIPTION OF PREFERRED EMBODIMENTS

FIGS. 1–14 illustrate a portable desk 20 according to preferred embodiments of this invention. Preferably, portable desk 20 is made of a suitable material, such as a thermoplastic material which can be made using an injection molding process. It is apparent to those skilled in the art and guided by the teachings herein provided that portable desk 20 can be made of any suitable material, using any suitable manufacturing process. Preferably, the material chosen for portable desk 20 is a light weight material for easy transportability.

Figure 1:
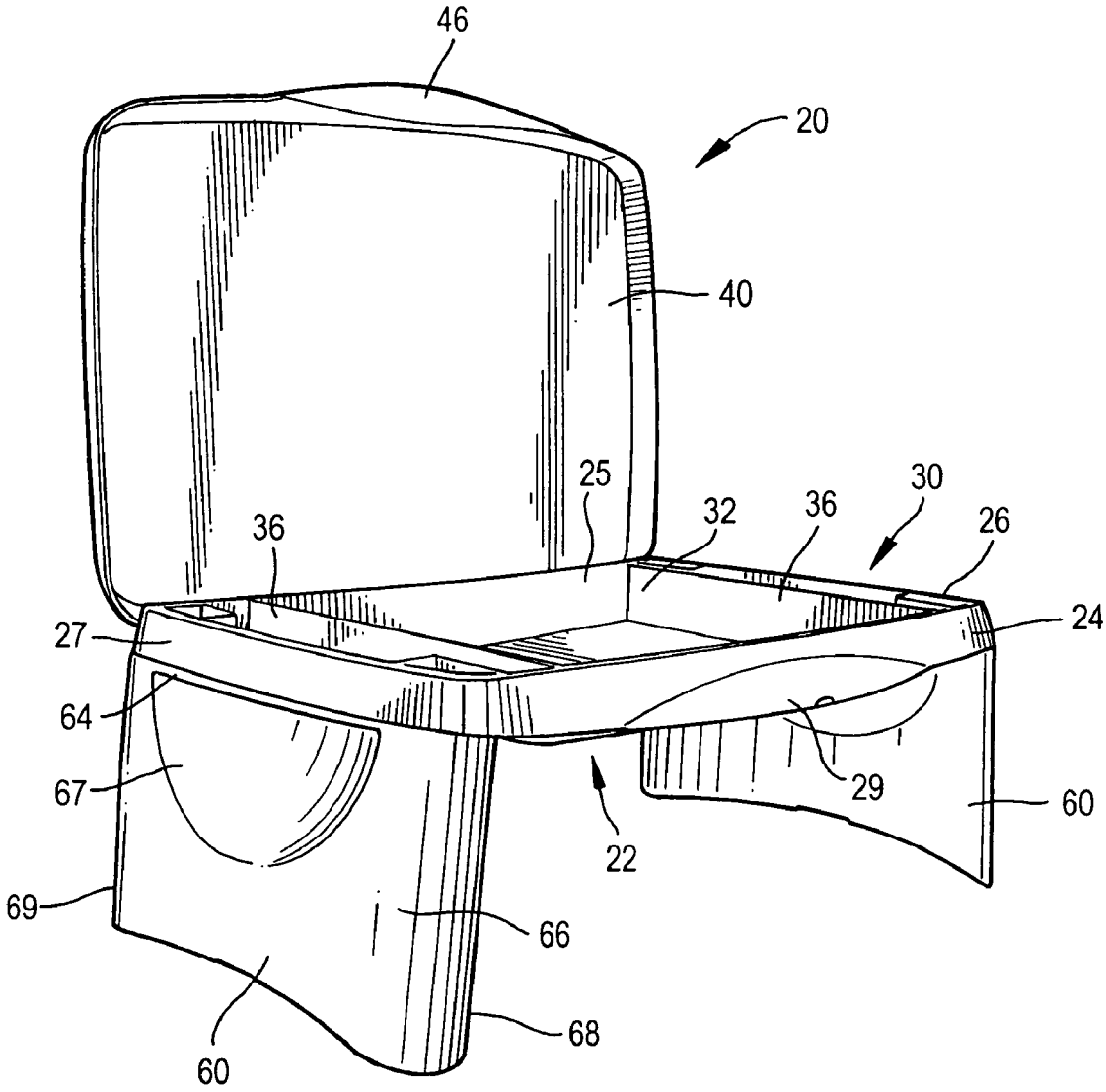
FIG. 1 is a perspective view of a portable desk with a top portion in an open position and pivotally connected legs in an extended position, according to one preferred embodiment of this invention.
Figure 13:
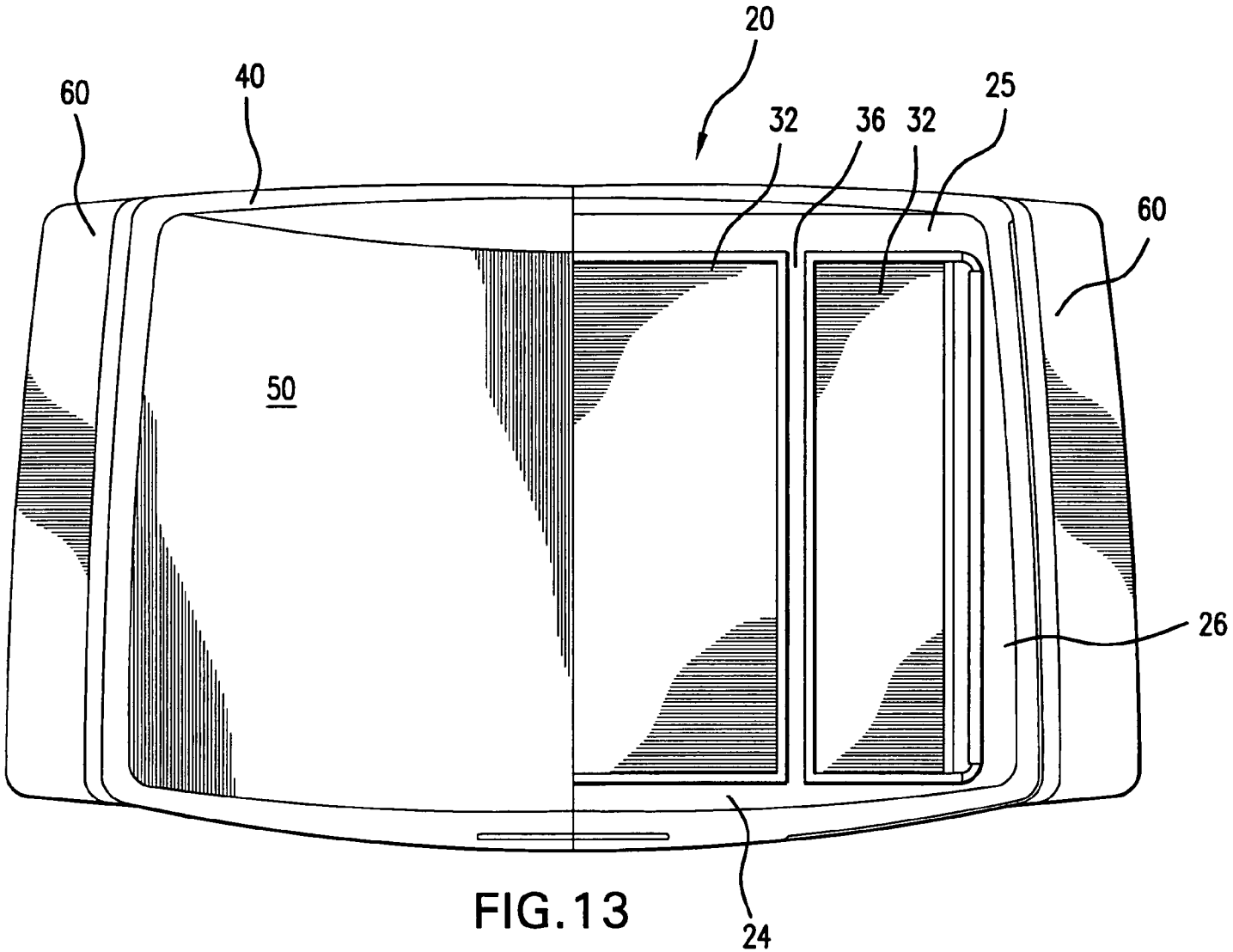
FIG. 13 is a sectional top view of a portable desk, according to one preferred embodiment of this invention.

Portable desk 20 comprises a base 22 that includes side walls 24,25,26, 27 and a bottom surface 28 which collectively define a storage space 30. In one preferred embodiment of this invention, as shown in FIGS. 1 and 13, storage space 30 includes a plurality of compartments 32 for storing and grouping writing utensils, arts and crafts supplies and working materials. Preferably, compartments 32 are integrally formed with bottom surface 28. In one preferred embodiment of this invention, compartments 32 are formed by at least one integrated support wall 36 that extends between first side wall 24 and opposing second side wall 25, as shown in FIGS. 1 and 13. Integrated support wall 36 provides structural rigidity to portable desk 20 and allows the use of light weight, injection molded materials to be used for manufacturing portable desk 20. Portable desk 20 may include any number of integrated support walls 36, for example two support walls 36 as shown in FIG. 1, to form any suitable number of compartments 32.

Figure 2:
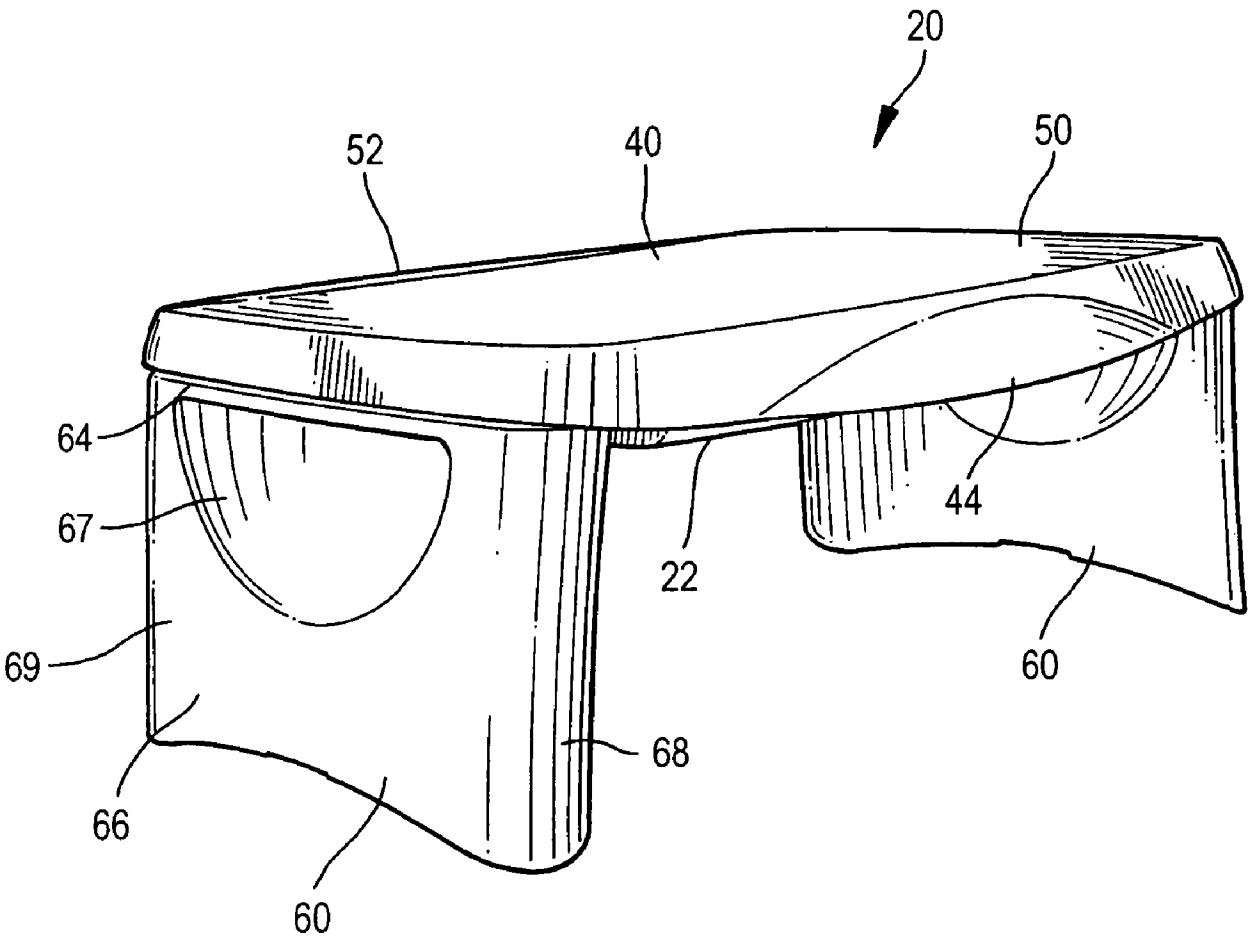
FIG. 2 is a perspective view of a portable desk with a top portion in a closed position and pivotally connected legs in an extended position, according to one preferred embodiment of this invention.
Figure 5:
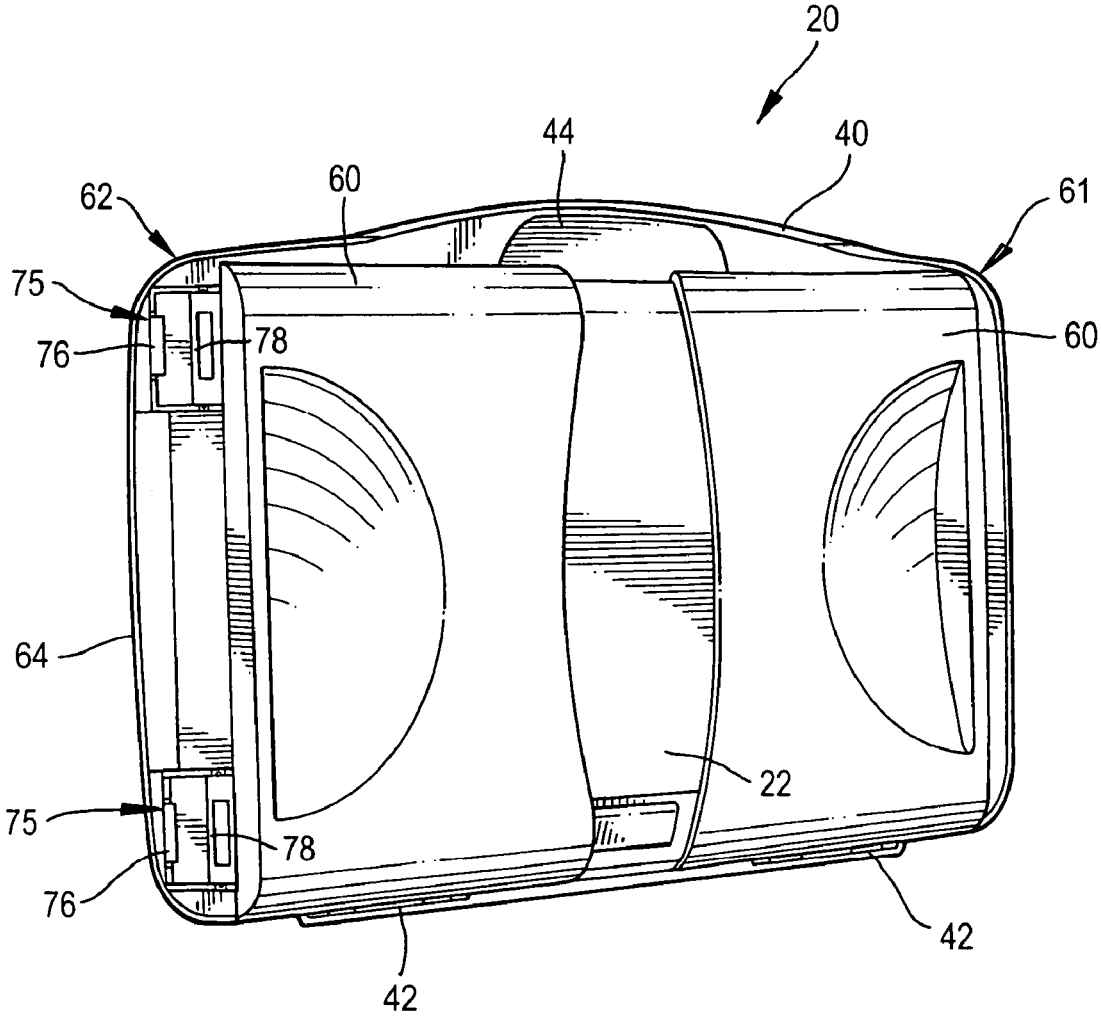
FIG. 5 is a perspective view of a portable desk forming a case structure, according to one preferred embodiment of this invention.
Figure 6:
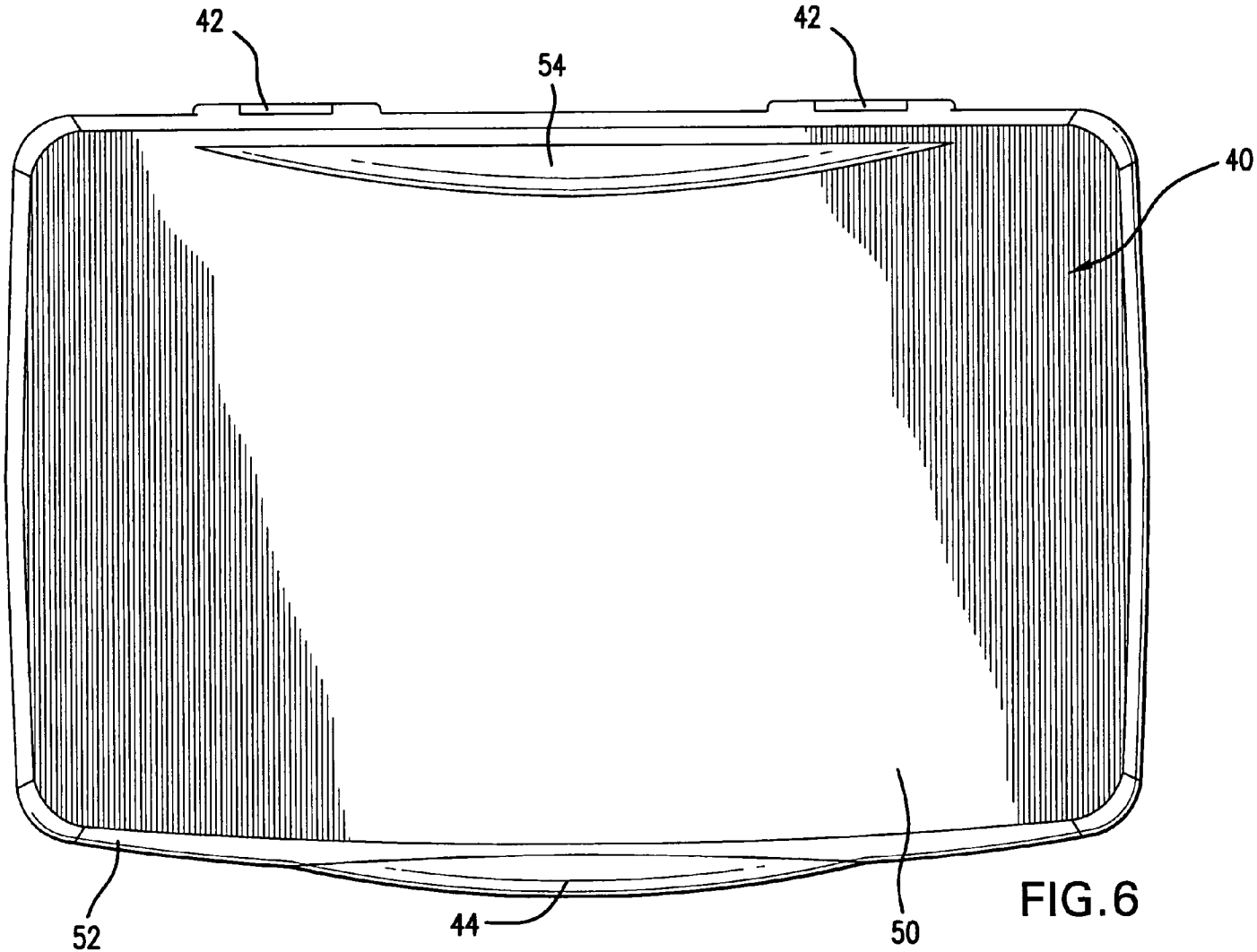
FIG. 6 is a top view of a portable desk, according to one preferred embodiment of this invention.
Figure 7:
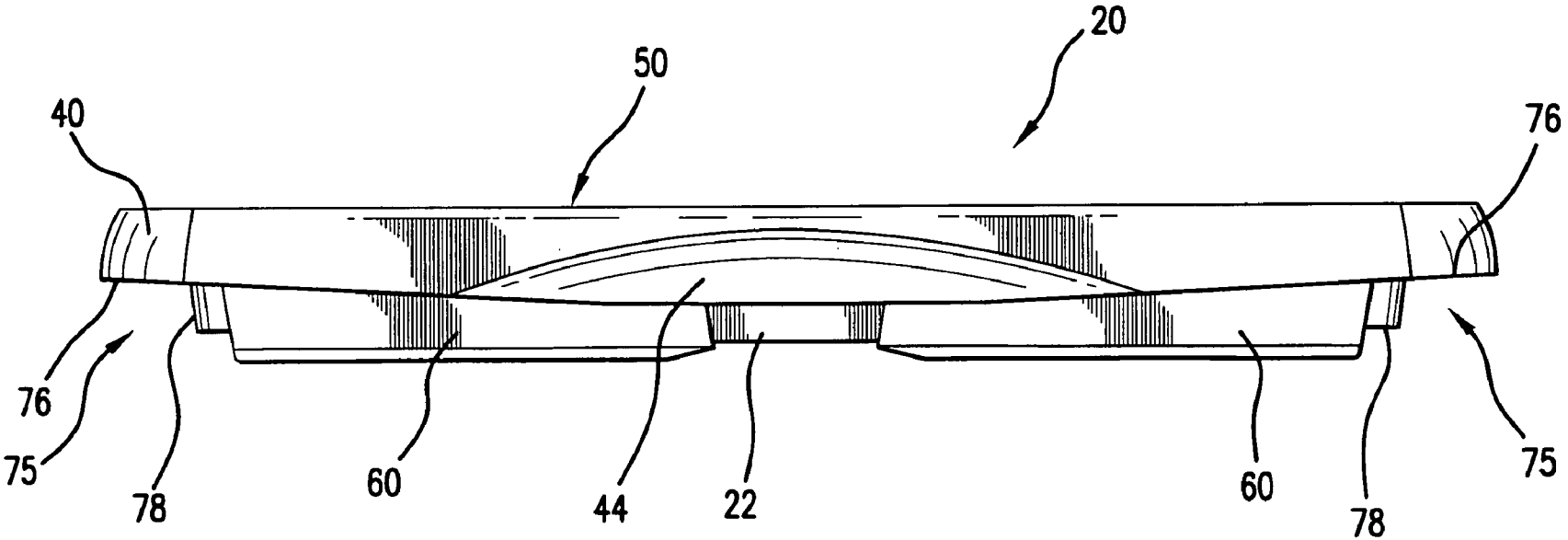
FIG. 7 is a front view of a portable desk, according to one preferred embodiment of this invention.

Portable desk 20 further comprises a top portion 40 hingedly attached or connected to base 22 and movable with respect to base 22 between an open position, as shown in FIG. 1, and a closed position, as shown in FIG. 2. Preferably, top portion 40 is hingedly attached or connected to base 22 using a suitable hinge connection. The hinge connection can be formed by a thin film or an injection molded hinge element or may comprise a suitable mechanical hinge element 42, as shown in FIGS. 5 and 6, which allows top portion 40 to move or pivot with respect to base 22.

Figure 8:
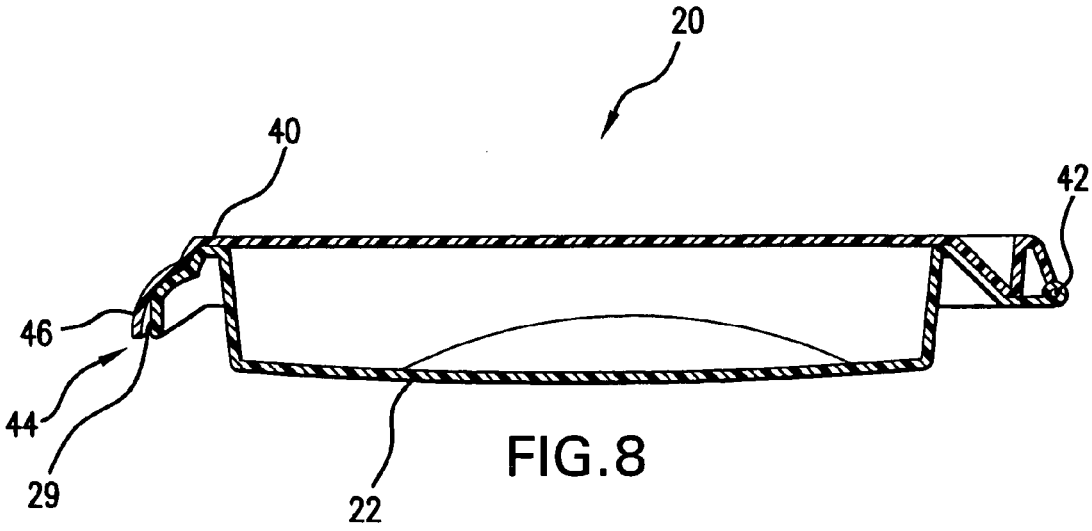
FIG. 8 is a cross-sectional side view of a portable desk, according to one preferred embodiment of this invention.
Figure 9:
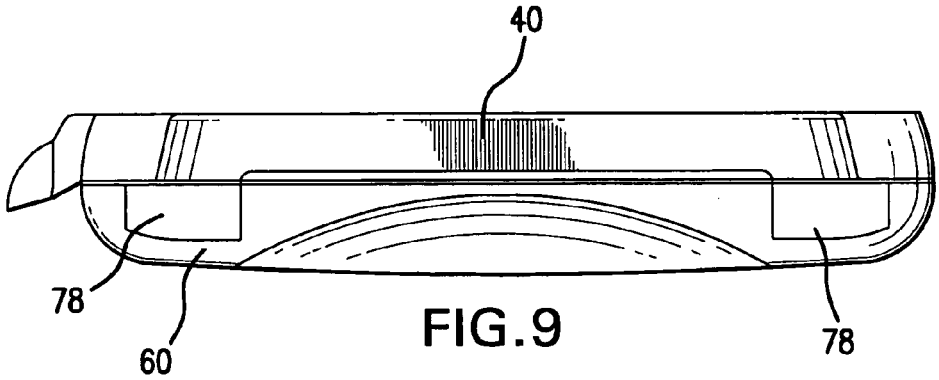
FIG. 9 is a side view of a portable desk, according to one preferred embodiment of this invention.

In the closed position, top portion 40 is positionable over base 22 to contain materials stored within compartments 32. Further, top portion 40 when positioned over base 22 preferably forms an integrated carry handle 44. In one preferred embodiment of this invention, as shown in FIG. 8, top portion 40 comprises a tab section 46 that interferes with or engages a shoulder 29 of base 22, in the closed position to form a locking mechanism or element. The locking mechanism allows top portion 40 to be securely connected with respect to base 22 to cover storage space 30 and prevent any materials or utensils contained within storage space 30 from spilling from portable desk 20, if for example the user drops portable desk 20.

Top portion 40 further comprises a top surface 50. Preferably, at least a portion of top surface 50 is generally smooth and flat to provide a working surface for the user to write or draw, for example. In one preferred embodiment of this invention, top surface 50 includes an integrated ridge or a wall 52 that extends about at least a portion of a periphery of top surface 50. Preferably, wall 52 extends about the entire periphery of top surface 50 to prevent materials, such as writing utensils, from falling or rolling off top surface 50 during use. Additionally, a portion of top surface 50 can form a recessed storage void 54 to temporarily store materials, such as pencils, markers or pens, when using portable desk 20.

Figure 3:
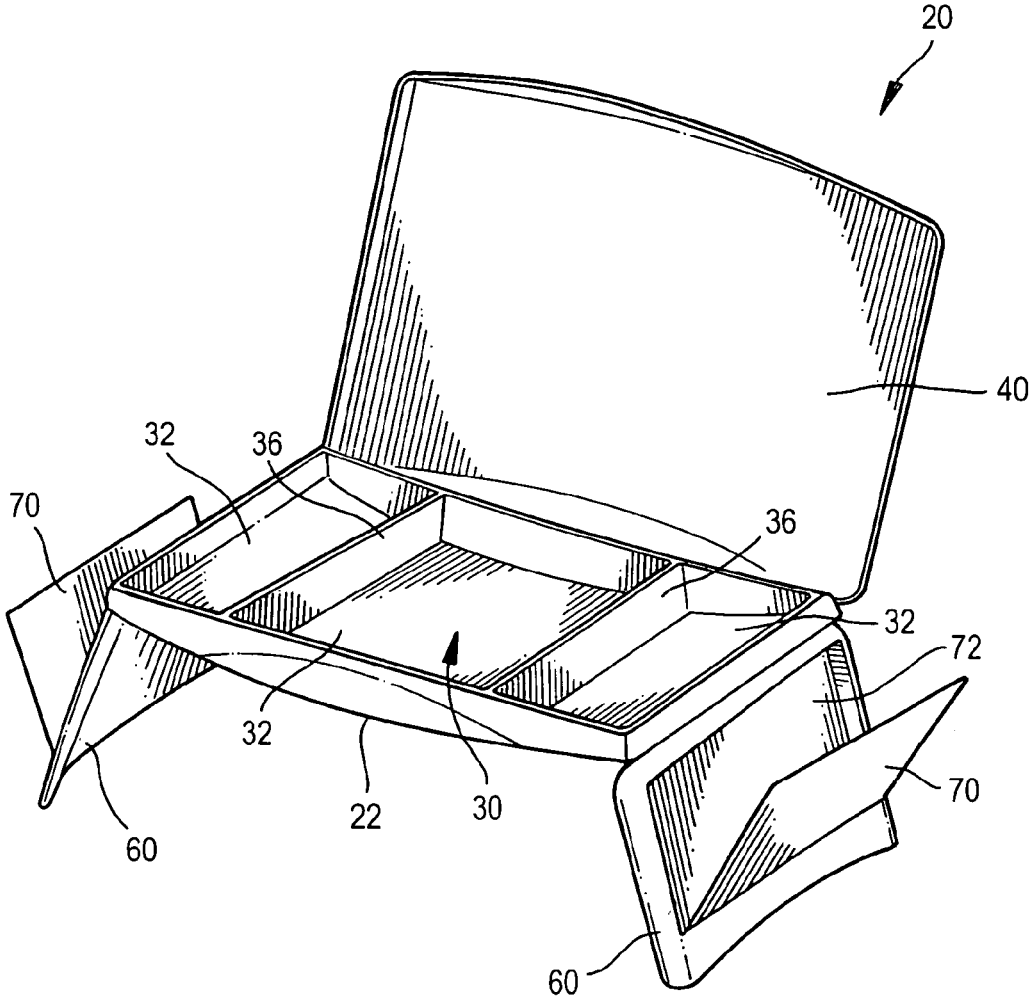
FIG. 3 is a perspective view of a portable desk with a top portion in an open position and pivotally connected legs, including storage areas, in an extended position, according to one preferred embodiment of this invention.
Figure 4:
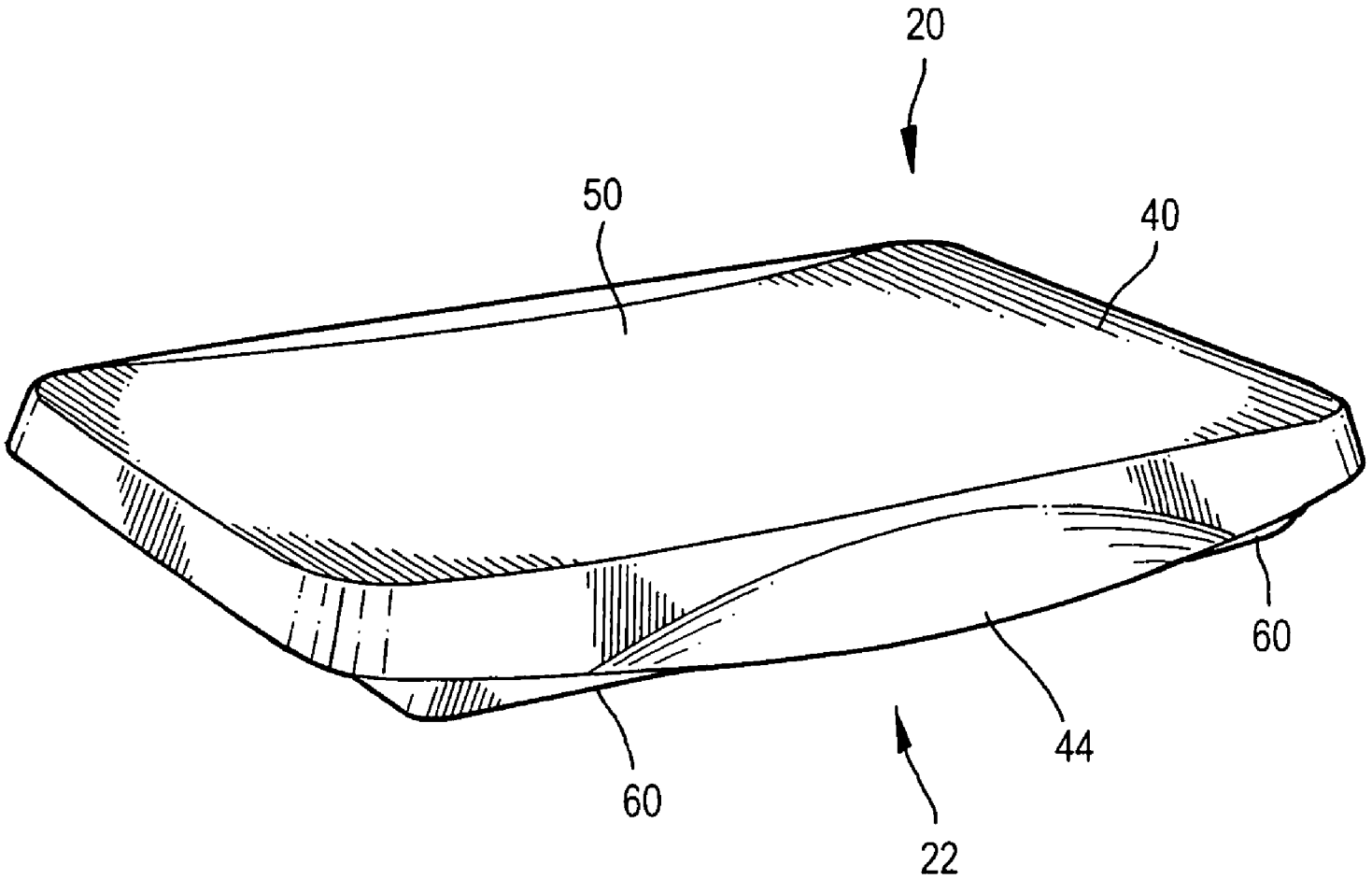
FIG. 4 is a perspective view of a portable desk forming a case structure, according to one preferred embodiment of this invention.
Figure 11:
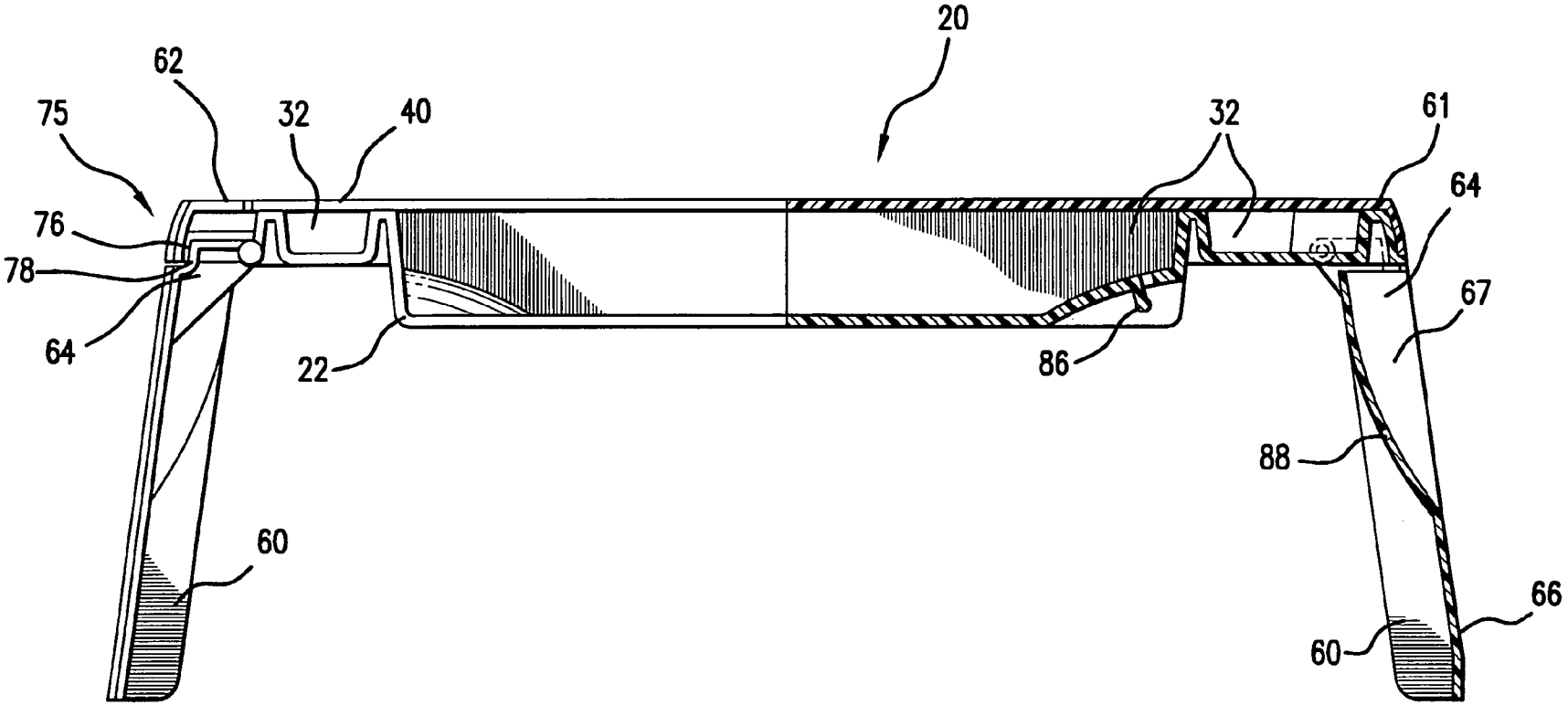
FIG. 11 is a partial cross-sectional side view of a portable desk, according to one preferred embodiment of this invention.

Portable desk 20 preferably comprises two legs 60 positioned at opposing end portions 61, 62 of base 22 and pivotally connected or attached to base 22. Preferably, legs 60 are pivotally movable between a retracted position, as shown in FIGS. 4 and 5, and an extended position, as shown in FIGS. 1–3. In one preferred embodiment of this invention, a first leg 60 is positioned at first end portion 61 and a second leg 60 is positioned at second end portion 62, as shown in FIG. 11. Each leg 60 is pivotally connected to base 22 and pivotally movable with respect to base 22 between the retracted position and the extended position.

Each leg 60 can be pivotally connected or attached to base 22 using any suitable mechanical connection or a pivotal connection can be formed by a thin film or an injection molded element. For example, in one preferred embodiment of this invention, a pin is positioned or mounted with respect to base 22 and inserted into an aperture formed at an end portion 64 of leg 60 to pivotally connect or attach leg 60 to base 22.

Figure 12:
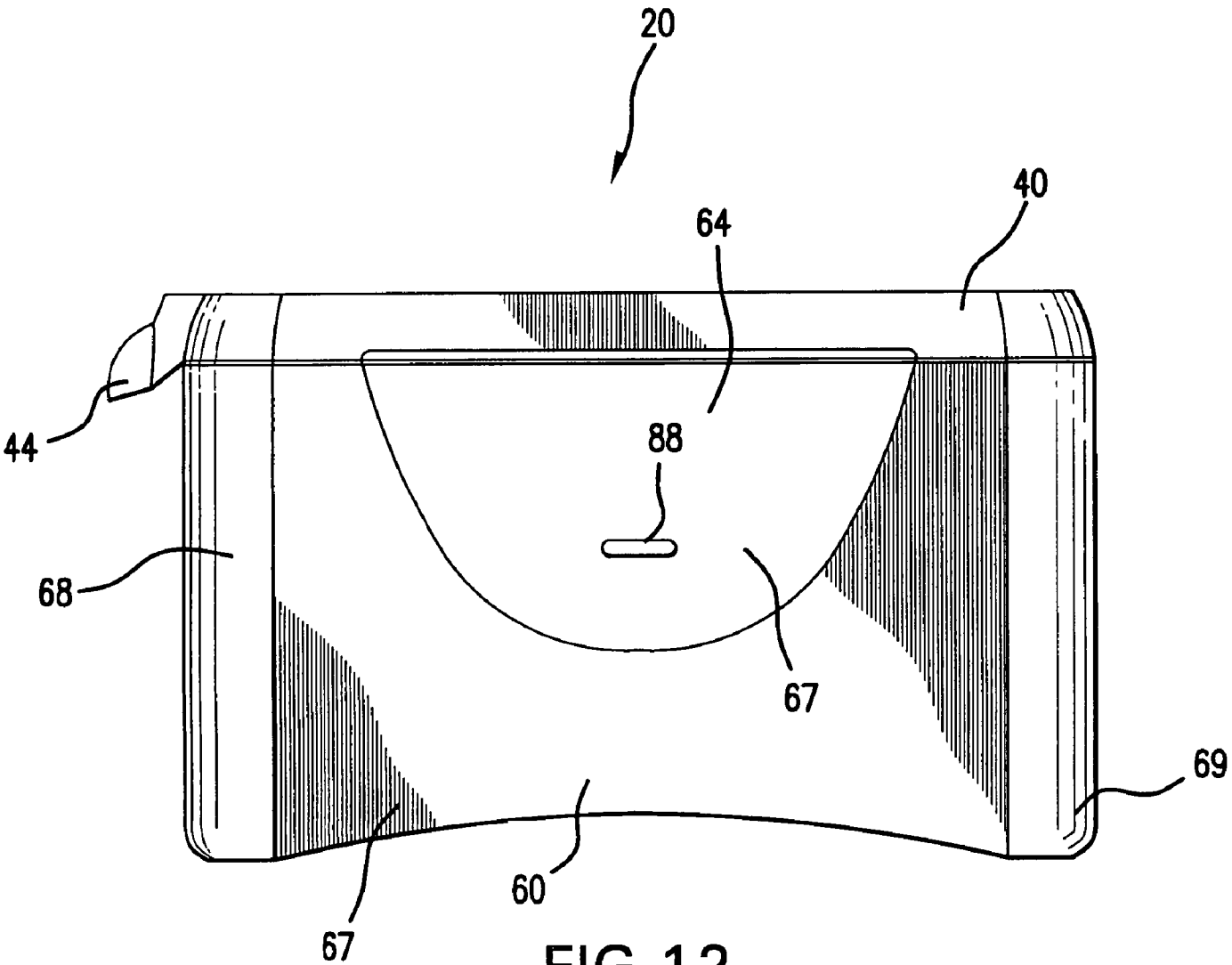
FIG. 12 is a side view of a portable desk, according to one preferred embodiment of this invention.

In one preferred embodiment of this invention, each leg 60 has an outer surface 66 forming a recessed portion 67, as shown in FIGS. 1, 2, 11 and 12. Preferably, but not necessarily, recessed portion 67 is formed in a center region of outer surface 66 and extends with respect to base 22 to form a concave recessed portion. In one preferred embodiment of this invention, recessed portion 67 forms a handle within each leg 60 so that with legs 60 in the extended position, the user is able to pick up portable desk 20 and adjust its position with respect to the user, for example. Additionally or in the alternative, each leg 60 preferably comprises opposing edge portions 68, 69 having a curved or arcuate shape, as shown in FIGS. 1, 2 and 12. Preferably, opposing edge portions 68,69 each curve inwardly with respect to portable desk 20. Further, the curved or arcuate shape of edge portions 68, 69 preferably correspond to at least a portion of one of first side wall 24 and second side wall 25 of base 22, when leg 60 is in the retracted position to provide a smooth transition surface. The recessed portion 67 and/or the arcuate shaped edge portions 68, 69 of leg 60 provide added strength and rigidity to leg 60 in order for leg 60 to sufficiently support portable desk 20 when leg 60 is in the extended position.

In one preferred embodiment as shown in FIG. 3, each leg 60 comprises a cover 70 pivotally connected to leg 60 and positioned with respect to a storage compartment 72 formed by leg 60. Preferably, cover 70 is movable between an open position, for access to storage compartment 72, and a closed position, wherein cover 70 contains stored materials within storage compartment 72.

In one preferred embodiment of this invention, portable desk 20 further comprises at least one snap element 75 which secures or locks leg 60 with respect to base 22, in the extended position. Preferably, portable desk 20 comprises a plurality of snap elements 75 locking each leg 60 to a respective end portion 61, 62 of base 22. Each snap element 75 comprises a tab 76 formed on bottom surface 28 of base 22 at each of first end portion 61 and second end portion 62. Tab 76 interferes with or engages with a support edge 78 formed at end portion 64 of leg 60, in the extended position to lock leg 60 with respect to base 22.

Figure 10:
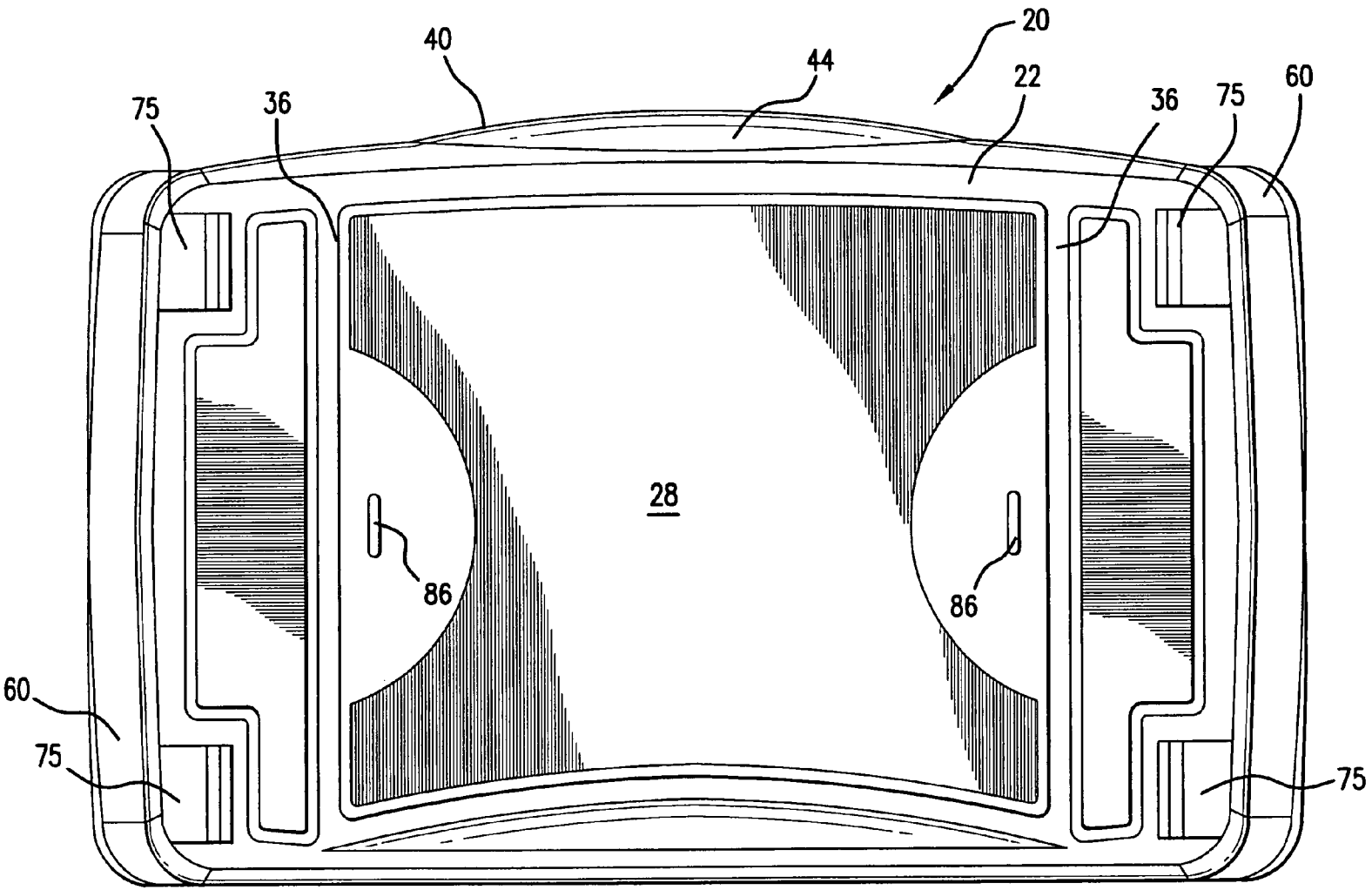
FIG. 10 is a bottom view of a portable desk, according to one preferred embodiment of this invention.
Figure 14:
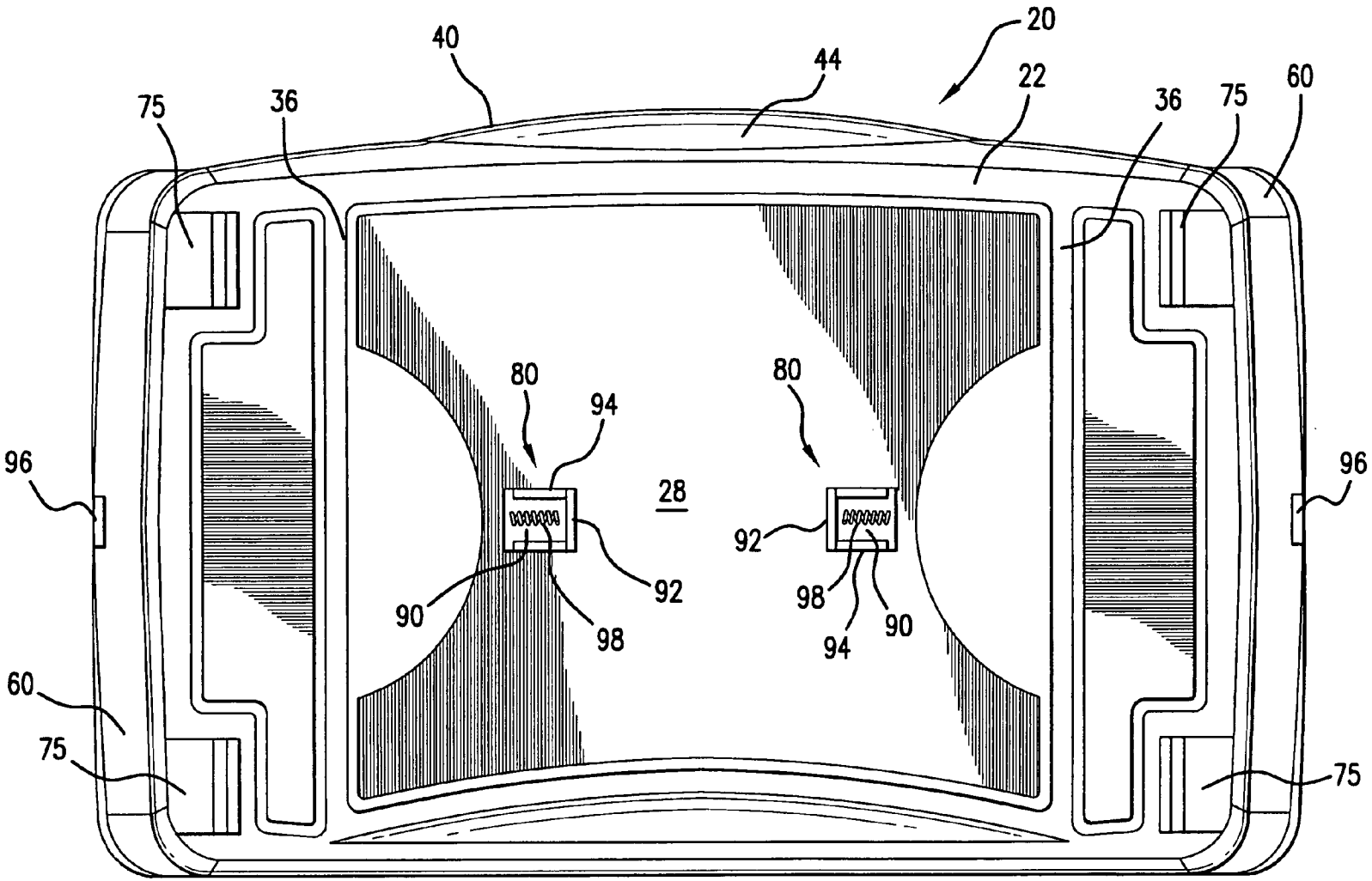
FIG. 14 is a bottom view of a portable desk, according to one preferred embodiment of this invention.

In a closed position, each leg 60 is folded with respect to base 22 and is preferably secured or locked in the closed position using a suitable locking mechanism or element, such as a tab lock arrangement, such as shown in FIG. 10, a fastener arrangement including mating VELCRO strips, or a spring-loaded locking arrangement, such as shown in FIG. 14.

Referring to FIG. 10, in one preferred embodiment of this invention, the locking mechanism or element 80 comprises at least one projection 86 attached or connected to base 22. Preferably, projection 86 is integrally formed with base 22 during an injection molding process. Projection 86 is positionable within an aperture, a slit or a void 88 formed in leg 60. Projection 86 interferes with aperture 88 preferably formed in concave recessed portion 67 of leg 60 to lock or maintain leg 60 in the retracted position with respect to base 22, when portable desk 20 is being stored or transported.

In one preferred embodiment of this invention, as shown in FIG. 14, locking mechanism or element 80 comprises a spring-loaded block 90 having a beveled edge 92 that is movably positioned on or mountable to a support piece 94. Preferably, support piece 94 is permanently connected or attached with respect to base 22. Alternatively, support piece 94 can be integrally formed with base 22. Spring-loaded block 90 interferes with or engages a tab section 96 formed on a bottom end portion of leg 60 to lock or maintain leg 60 in the retracted position with respect to base 22. As leg 60 is pivotally moved from the retracted position to the extended position, a force applied to spring-loaded block 90 moves spring-loaded block 90 in a direction to prevent beveled edge 92 from interfering with tab section 96, allowing leg 60 to pivot to the extended position. A spring 98 is positioned within spring-loaded block 90 to urge spring-loaded block 90 to an initial position.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A portable desk comprising:

a base defining a storage space, the base including a shoulder formed in a side wall;

a top portion hingedly attached to the base and movable between an open position and a closed position, the top portion including a tab portion that, when the top portion is in the closed position, is disposed over the shoulder and the tab portion and the shoulder form an integrated carry handle;

two legs positioned at opposing end portions of the base and pivotally connected to the base, each leg of the two legs pivotally movable between a refracted position and an extended position, each leg having an outer surface forming a recessed portion in a center region of the outer surface, the recessed portion extending with respect to the base and forming a handle within each leg; and at least one snap element locking each leg to the base in the extended position.

2. The portable desk of claim 1 wherein the storage space has a plurality of compartments formed by at least one integrated support wall extending between a first side wall of the base and an opposing second side wall of the base.

3. The portable desk of claim 1 wherein the top portion further comprises a top surface, and a wall extending about at least a portion of a periphery of the top surface.

4. The portable desk of claim 1 wherein the top portion further comprises a top surface, a portion of the top surface forming a recessed storage void.

5. The portable desk of claim 1 wherein each leg forms a storage compartment and a cover is pivotally connected to the leg and positioned with respect to the storage compartment.

6. The portable desk of claim 1 wherein each of the at least one snap element comprises a tab formed on a bottom surface of the base and interfering with a support edge formed at an end portion of one of the legs in the extended position.

7. The portable desk of claim 1 wherein each leg further comprises opposing edge portions having an arcuate shape.

8. The portable desk of claim 1 wherein the storage space comprises a plurality of compartments integrally formed in a bottom surface of the base.

9. The portable desk of claim 1, wherein the tab portion comprises a locking mechanism for securely connecting the top portion to the base in the closed position.

10. A portable desk comprising:

a base;

a top portion hingedly attached to the base and movable between an open position and a closed position;

a first leg positioned at a first end portion of the base and pivotally connected to the base, the first leg pivotally movable with respect to the base between a refracted position and an extended position, the first leg having an outer surface, a concave recessed portion formed in a center region of the outer surface to form a handle within the first leg;

at least one snap element locking the first leg to the base in the extended position;

a second leg positioned at a second end portion of the base opposing the first end portion and pivotally connected to the base, the second leg pivotally movable with respect to the base between a refracted position and an extended position, the second leg having an outer surface, a concave recessed portion formed in a center region of the outer surface to form a handle within the second leg; and at least one snap element locking the second leg to the base in the extended position, and each of the at least one snap element comprises a tab section formed on a bottom surface of the base at each of the first end portion and the second end portion interfering with a corresponding support edge formed at an end portion of each of the first leg and the second leg.

11. The portable desk of claim 10 wherein the base forms a plurality of compartments defining a storage space.

12. The portable desk of claim 11 wherein the plurality of compartments are formed in a bottom surface of the base, and at least one integrated support wall extends between a first side wall of the base and an opposing second side wall of the base to form the plurality of compartments.

13. The portable desk of claim 10 wherein each of the first leg and the second leg forms a storage compartment, and a cover is pivotally connected to the leg and positioned with respect to the storage compartment.

14. The portable desk of claim 10 wherein in the closed position, the top portion is positioned over the base and forms an integrated carry handle.

15. The portable desk of claim 10 wherein the top portion further comprises a tab section interfering with a shoulder of the base, in the closed position.

16. The portable desk of claim 10 wherein the top portion further comprises a top surface, and a wall extending about a periphery of the top surface.

17. The portable desk of claim 10 wherein the top portion further comprises a top surface, a portion of the top surface forming a recessed storage void.

18. The portable desk of claim 10 wherein each of the first leg and the second leg comprises opposing edge portions having an arcuate shape.

19. A portable desk comprising:

a base defining a storage space, the base including a shoulder formed in a side wall;

a top portion hingedly attached to the base and movable between an open position and a closed position, the top portion including a tab portion that, when the top portion is in the closed position, is disposed over the shoulder and the tab portion and the shoulder form an integrated carry handle;

two legs positioned at opposing end portions of the base and pivotally connected to the base, each leg of the two legs pivotally movable between a refracted position and an extended position; and at least one snap element locking each leg to the base in the extended position.

20. The portable desk of claim 19 wherein each leg comprises an outer surface having a concave portion.

21. The portable desk of claim 20 wherein the concave portion forms a handle within the leg.

22. The portable desk of claim 19 wherein the storage space has a plurality of compartments formed by at least one integrated support wall extending between a first side wall of the base and an opposing second side wall of the base.

23. The portable desk of claim 19 wherein the top portion further comprises a top surface, and a wall extending about at least a portion of a periphery of the top surface.

24. The portable desk of claim 19 wherein the top portion further comprises a top surface, a portion of the top surface forming a recessed storage void.

25. The portable desk of claim 19 wherein each of the at least one snap element comprises a tab formed on a bottom surface of the base and interfering with a support edge formed at an end portion of one of the legs in the extended position.

26. The portable desk of claim 19 wherein each leg further comprises opposing edge portions having an arcuate shape.

27. The portable desk of claim 19, wherein the tab portion comprises a locking mechanism for securely connecting the top portion to the base in the closed position.

* * * * *